United States Patent [19]

Thagard, Jr.

[11] 4,028,527

[45] June 7, 1977

[54] APPARATUS AND CONTROL SYSTEM FOR HEATING ASPHALT

[76] Inventor: George F. Thagard, Jr., 60 Linda Isle, Newport Beach, Calif. 92660

[22] Filed: Dec. 2, 1974

[21] Appl. No.: 528,732

[52] U.S. Cl. ..... 219/311; 126/343.5 A; 219/312; 219/330; 219/477; 219/483

[51] Int. Cl.[2] ..... F24H 1/18; H05B 1/00

[58] Field of Search ..... 219/311, 312, 316, 320, 219/321, 328, 330, 477, 483; 23/277 C; 110/8 A; 123/1, 136; 126/343.5 A; 122/13 A, 159–162; 55/350, 522, 527, 385, 510

[56] References Cited

UNITED STATES PATENTS

| | | | |
|---|---|---|---|
| 2,888,545 | 5/1959 | Kinney | 219/316 |
| 2,922,488 | 1/1960 | Gruner | 55/522 X |
| 3,004,130 | 10/1961 | Miller | 219/320 |
| 3,143,108 | 8/1964 | Rogers | 126/343.5 A |
| 3,280,301 | 10/1966 | Anderson et al. | 219/320 |
| 3,372,693 | 3/1968 | Gutzeit | 126/343.5 A |
| 3,522,692 | 8/1970 | Brookman | 55/522 X |
| 3,718,131 | 2/1973 | Busse et al. | 126/343.5 A |
| 3,759,015 | 9/1973 | Saxby | 55/350 |
| 3,804,079 | 4/1974 | Schrader | 126/343.5 A |

*Primary Examiner*—C. L. Albritton
*Attorney, Agent, or Firm*—Pennie & Edmonds

[57] ABSTRACT

An apparatus is disclosed for melting asphalt and for maintaining it in a molten condition without producing by-products harmful to the atmosphere. The asphalt is heated and maintained in a liquid state in an enclosed vessel by transferring heat from a heating means through inner wall portions of the vessel. Air polluting by-products are minimized due to the increased surface area heating the asphalt and the resulting reduced thermal gradient which prevents decomposition of the asphalt. A control system for selectively controlling the heating of the asphalt in a manner which reduces the production of air polluting products is also disclosed.

38 Claims, 7 Drawing Figures

Upper Heating Zone
Middle Heating Zone
Lower Heating Zone
Control Circuit
Control Circuit
Control Circuit
Temp. Regulator
Temp. Regulator
Temp. Regulator
Gen.

Upper Heating Zone
Middle Heating Zone
Lower Heating Zone
POWER SOURCE
BOILER (STEAM)
CONTROL

POWER SOURCE
BOILER (STEAM)
CONTROL

Upper Heating Zone
Middle Heating Zone
Lower Heating Zone

APPARATUS AND CONTROL SYSTEM FOR HEATING ASPHALT

BACKGROUND OF THE INVENTION

1. Field of the Invention

This invention relates to an apparatus and control system for heating asphalt to maintain it in a molten state while avoiding the production of volatile air polluting by-products.

2. Description of the Prior Art

Asphalt is widely used as a material for waterproofing roofs because it is relatively inexpensive and in its molten state is relatively easy to apply. Ordinarily, roofing contractors keep a gas-fired kettle at the job site in which solid asphalt is melted and maintained at approximately 500° F. The asphalt when melted in this manner, however, emits a great amount of volatile hydrocarbon vapors into the atmosphere. These hydrocarbon vapors create such air-pollution problems that local governing bodies have proposed regulations restricting the use of the open kettles widely used by roofers for melting asphalt.

Asphalt emits few pollutants when heated to only approximately 500° to 510° F because it is relatively nonvolatile at that temperature; the asphalt vapor which does escape into the atmosphere from the surface of molten asphalt condenses quickly and therefore is not a serious air-pollution problem. Nevertheless, gaseous pollutants are formed because of the high temperature at which the heating element of the kettle is operated.

Conventional asphalt kettles are heated by gas-fired flame tubes, which are metal tubes immersed in the molten asphalt into which a gas burner directs a flame. Because of the relatively low thermal conductivity of asphalt, the surface of the flame tube must be maintained at 1000° to 1500° F in order to melt the asphalt within a reasonable time. Although at these high temperatures the bulk of the asphalt melts relatively quickly, the asphalt immediately adjacent to the surface of the flame tube is heated to above its decomposition temperature. The decomposition products of asphalt give rise to air-pollution problems. Since the decomposition products of asphalt include light volatile fractions which can escape into the atmosphere and do not condense at ambient temperatures, they disperse a great distance from the asphalt kettle and constitute a major source of air-pollution from conventional asphalt kettles.

An additional problem arises because the decomposing asphalt deposits coke-like residue on the surface of the flame tube. These deposits are poor heat conductors and thus reduce the efficiency of the heat transfer from the flame tube to the asphalt. Accordingly, the flame tubes of asphalt kettles must be cleaned frequently—a messy and difficult task.

One attempt to solve some of the problems of asphalt kettles heated with flame tubes is a tank truck for delivering molten asphalt. The tank is vented to the atmosphere through a filter which removes condensable vapors generated in the tank. Noncondensable vapors, however, can pass through the filter to the atmosphere. The asphalt in the tank is heated by a flame spreader, which is a large-diameter heating chamber immersed in the tank in contact with the asphalt.

While this development has reduced the air pollutants somewhat by heating the asphalt to lower temperatures than the gas-fired kettles, it nevertheless has many inherent disadvantages. For example, the tank capacity is greatly reduced because of the large volume occupied by the flame spreader. In addition, the temperature of the active surfaces have been so high that coke accumulations—an indicator of asphalt decomposition—have to be periodically removed from the surfaces. Volatile by-products of the coke deposits are not completely prevented from polluting the atmosphere by the relatively simple filter provided. Moreover, as the tank is emptied and the level of asphalt is reduced, the flame spreader becomes exposed with the result that the temperature of the exposed portion increases causing further asphalt decomposition on these surfaces.

Since the physical law which describes the transfer of heat across a surface dictates that the amount of heat carried across the surface is directly proportional to the product of the surface area and the temperature gradient at the surface, it can be seen that increasing the temperature difference between the bulk of the asphalt and a surface in contact therewith increases the rate of flow of heat to the asphalt because the thermal gradient at the surface of contact is increased. However there is a practical limit to the rate of heat which can be achieved by this method since as the temperature of the surface approaches the decomposition temperature of asphalt, serious air pollution problems result. Accordingly it follows from the law of heat transfer that for a fixed flow of heat to the asphalt, the thermal gradient can be reduced if the area in contact with the asphalt is increased proportionately. I have invented an apparatus and a control system for heating asphalt to temperature levels sufficient to maintain it in a molten state by increasing the area in thermal contact with the asphalt and thereby reducing the thermal gradient thus preventing decomposition of the asphalt, minimizing the formation of atmospheric pollutants, and avoiding the disadvantages of the prior art.

SUMMARY OF THE INVENTION

An apparatus for heating and maintaining a material such as asphalt to temperatures within preselected ranges. The apparatus comprises an enclosed vessel configured to contain the material in at least one of a solid and liquid state, with means for introducing the material in at least one of a solid and liquid state. The apparatus further comprises means for heating wall portions of the vessel to maintain at least one of the temperature of the inner wall portions which contact the material therein and the material in the vessel within preselected temperature ranges. Venting means communicating an upper portion of the vessel with an atmosphere outside of the vessel provides venting of the inner portion of the vessel above the material therein. The apparatus further comprises filtering means connected to said venting means for filtering condensable vapors such as hydrocarbon vapors passing therethrough. The apparatus further comprises outlet means for removing the material from said vessel. In the preferred embodiment the invention is adapted to maintain asphalt in a molten condition between approximately 500°–510° F and below its decomposition temperatures.

It can be seen that the walls of the vessel itself serve as a heat source for the asphalt. Because this surface area is relatively large compared to the surface area of a flame tube or flame spreader immersed in a vessel of the same size, the walls of the present vessel may be maintained at a lower temperature than the surfaces of the prior art heaters, yet they achieve the same rate of heat transfer to the asphalt. In addition the capacity of the tank is not diminished by the presence of a flame tube or spreader.

The vessel of the present invention is preferably well insulated in order to minimize heat losses from the asphalt, thereby reducing the amount of heat which must be supplied to make up for the heat losses. Reducing the amount of heat which must be supplied to the asphalt, of course, permits the use of still lower temperatures for the heated surface in contact with the asphalt in addition to reducing the power consumption of the vessel.

The walls of the vessel of the present invention may be heated by a number of techniques. In the preferred embodiment, electrical resistance elements are secured to the vessel so that they make thermal contact with the walls. A double wall construction is formed by two nested vessels defining a space or chamber therebetween in which the electrical resistance elements heat inner wall portions of the vessel. Alternatively steam may be introduced through steam coils positioned between the vessels or a heating fluid or combustion gases may be circulated in the space between the walls, the latter embodiment requiring both vessel walls to be of a fluid impermeable and pressure resistant construction.

In the preferred embodiment the heat supplied to the asphalt is electrically regulated. A temperature sensor is either immersed in the molten asphalt or it may be secured to wall portions of the vessel in a manner such that it will detect the temperature of the inner wall portion. The sensor is ultimately used to regulate the temperature of the walls of the vessel in order to maintain the asphalt at the desired temperature. When electrical resistors are used as heating elements, the temperature sensor may be connected to a temperature controller which, by means of mechanical relays or electronic switches, controls the electric current supplied to heat the resistors and thus regulates the temperature of the asphalt.

A preferred method of regulating the heat supplied to the asphalt resides in dividing the walls of the vessel into horizontal heating zones with each zone being heated independently. Thus, for example, electrical heating strips may be attached to the sides of the vessel so that they run horizontally in one heating zone, parallel to the surface of the molten asphalt, and are connected to a single power regulator. Alternatively when steam coils are used they may be deployed in a similar manner. The advantage of this arrangement is that as asphalt is withdrawn from the vessel and the level falls below one of the heating zones, the power to the heaters for that zone may be reduced so that the temperature of the zone does not rise above the decomposition temperature. Thus asphalt adhering to the wall is not decomposed by excessive temperatures. This further reduces the possibility of hydrocarbon emissions. Power supplied to the heating elements in the individual heating zones may be controlled by sensing the level of the asphalt in the vessel or, preferably, by sensing the temperature of the wall in each heating zone.

The vessel of the present invention may be mounted on a trailer or truck bed in order to make the supply of molten asphalt portable, as is advantageous for the construction industry. If electrical resistance elements are used to heat the vessel, an electric generator may be mounted on the vehicle along with the vessel, making the molten asphalt supply self-contained. If steam or combustion gases are used to heat the asphalt, a boiler or burner may similarly be mounted on the vehicle.

To reduce hydrocarbon emissions further, the vessel is substantially completely enclosed with its interior vented to the atmosphere through a filtering means which removes the condensable vapors generated in the vessel. Since the asphalt is heated by surfaces which are preferably only slightly above the desired temperature of the asphalt for application to roofs and therefore well below the decomposition temperature, there will be very little asphalt decomposition in the vessel. The principal vapor given off by the molten asphalt will be asphalt vapor itself, which is easily removed by the filter. Thus volatile decomposition products will be reduced compared to vessel heated with flame tubes or spreaders.

Where electric power is generated, the generator is driven by a fuel-burning motor such as a diesel or gasoline engine. Alternately a gas turbine may be mounted on the vehicle. It is advantageous to vent the output of the filter into the fuel/air intake of the motor such that any small amounts of hydrocarbon vapors which may pass through the filter will be burned in the motor and not allowed to escape into the atmosphere. Diesel motors are available for powering electric generators which emit relatively few hydrocarbon vapors and therefore do not present a serious air-pollution problem.

Molten asphalt may be withdrawn from the vessel through a simple tap; however, in the preferred embodiment the apparatus is equipped with a pump for pumping molten asphalt out of the vessel and up onto the roofs of buildings. The pump is submersible and is inserted in a port located on top of the vessel. The hot asphalt may be pumped to the roof through an insulated hose, an electrically-heated hose, or conventional pipelines.

The present invention may be conveniently parked at a job site and there used to melt and store asphalt as it is needed on the job. In this case the capacity of the vessel is preferably comparible to the capacity of conventional asphalt kettles, roughly 750 gallons. If sources of electric power or steam are available at the site, the vessel need not be equipped with a generator or boiler. Alternatively the present invention may be used for an asphalt delivery system in regions located near oil refineries. In this case the vessel and means for heating it, such as an electric generator or water boiler, are mounted on a truck or tractor-trailer so that the asphalt may be maintained in the molten state as it is transported. The vessel may be filled at the refinery with molten asphalt which may then be delivered to several roofing jobs. Since asphalt is produced at a refinery in the molten state, energy is conserved by delivering the molten asphalt to roofers directly instead of cooling and packaging it before delivery.

The present invention is not limited to use with roofing asphalt, but may be used to melt, store, or transport similar material such as greases, waxes, and vegetable oils.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
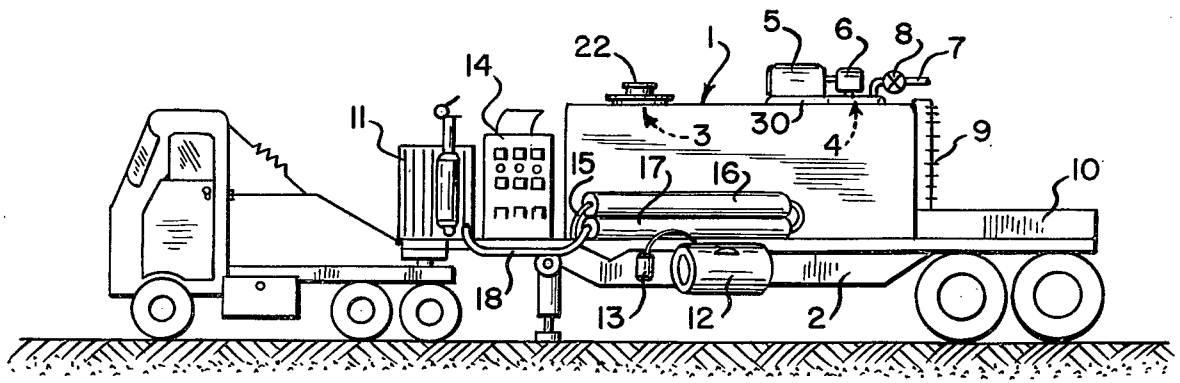
FIG. 1 is a side view of the apparatus of the present invention illustrating an asphalt heating vessel and diesel powered electrical generator mounted on the trailer portion of a vehicle.

Referring to FIG. 1 a vessel in the form of a tank 1 for heating molten asphalt is mounted on a trailer 2 of a vehicle. The tank has two ports 3 and 4. The tank is filled with asphalt through port 3 and molten asphalt is withdrawn from the tank through port 4. Electric motor 5 is mounted on the top of the tank for driving a submersible pump 27 immersed in the molten asphalt. Motor 5 is connected to a right angle drive 6 which permits the motor to be coupled to the pump 27 located at the bottom of tank 1. The asphalt is pumped out of pipe 7 through valve 8. Ladder 9 is provided for servicing the pump assembly. Utility cabinet 10 is provided for storage of hoses or pipes (not shown) which would be connected to output pipe 7 for pumping asphalt up to the roofs of buildings or other elevations in which it may be required.

As shown in the drawings, the tank 1 is electrically heated. A diesel-powered electric generator 11 is mounted on trailer 2 and a diesel motor — preferably of a type which emits few air pollutants — is provided which powers the electric generator 11. Fuel for the diesel motor is supplied by a tank 12 mounted on the lower portion of trailer 2 as shown in FIG. 1, with the fuel being supplied to the diesel motor by booster pump 13. A control panel 14 is positioned behind generator 11 and connected to it in a manner which operatively controls, in a selective manner, pump motor 5, generator 11, and temperature of the molten asphalt in tank 1. Temperature regulation circuits are mounted behind control panel 14 and circuit breakers for the power lines to the heater circuits, which are mounted on the lower portion of trailer 2 opposite tank 12, are not shown.

The interior of tank 1 is vented through vent line 15. Vent line 15 connects to the top of the interior of the tank at port 3 and extends downwardly through the insulation of the tank along one end. The vent line exits the tank 1 at the bottom portion and is connected to filter canister 16 mounted on the side wall of the tank. The filter canisters 16 and 17 are tubular members which contain a filter material such as fiberglass or polyurethane foam for removing condensable vapors passing through vent line 15. The canisters are connected in series as shown, with the output of canister 16 connected to the input of canister 17 and the output of canister 17 connected by pipe 18 to the air intake of the diesel motor of generator 11. Thus, hydrocarbon vapors which pass through filters 16 and 17 are burned to the diesel motor thereby preventing these vapors from entering the atmosphere.

Figure 2:
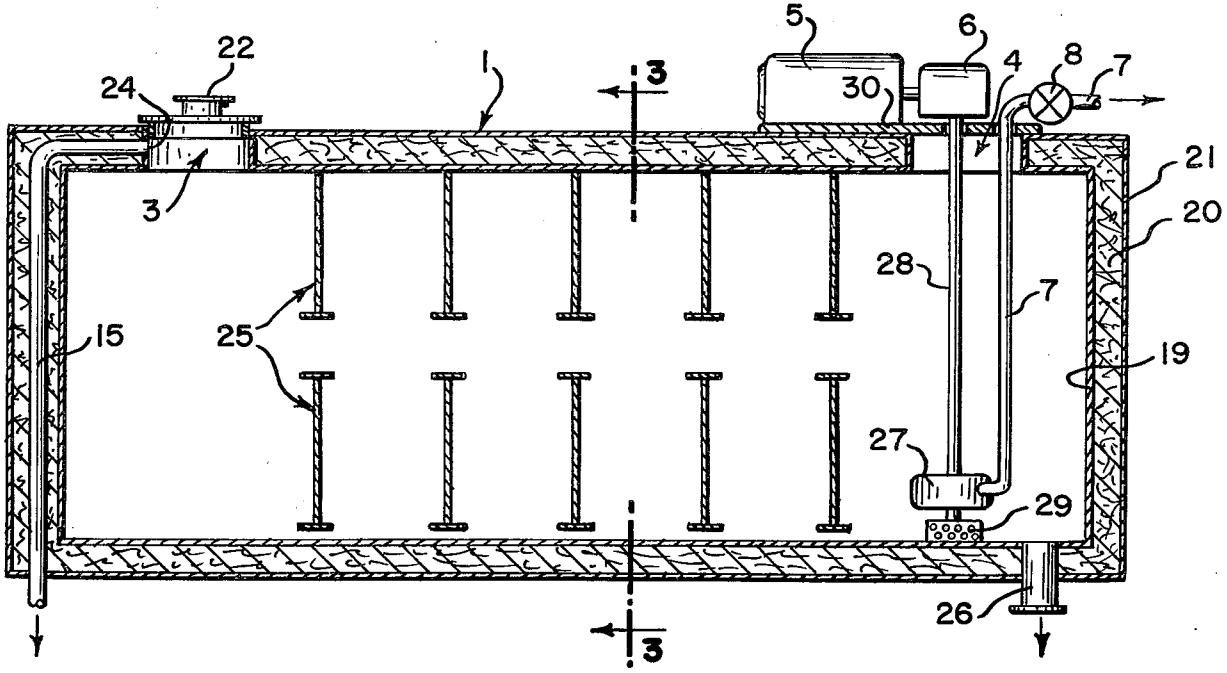
FIG. 2 is a cross-sectional view taken lengthwise of the tank portion of the apparatus illustrated in FIG. 1.

Referring now to FIG. 2 there is shown a cross-section of the tank 1 of FIG. 1. The tank is constructed of three layers. An inner vessel 19 actually contains the molten asphalt and provides the surfaces to which heat is imparted to the asphalt. Vessel 19 is surrounded by a layer 20 of insulating material such as fiberglass. The fiberglass insulation is enclosed in an outer vessel in the form of an aluminum skin 21.

As shown in FIG. 2, the inner vessel 19 is filled with asphalt through port 3 which is equipped with a sealing cap 22. Vent line 15 is connected to the interior of the vessel through opening 24 to port 3 below cap 22 and extends through insulating layer 20 until it exits from the tank at the bottom portion where it is then diverted upwardly to filter canister 16. As can be seen in FIG. 2, the tank 1 is provided with baffles 25 which prevent the molten asphalt from splashing or sloshing in the tank as the trailer is being transported. A drain port 26 is provided at the bottom of the tank for draining it when required.

A submersible pump 27 is positioned within the vessel 19 and is connected to pump motor 5 by drive shaft 28, which is connected to right angle drive 6. Asphalt enters pump 27 through inlet strainer 29 and pumped out of the tank through line 7. Port 4 is sealed by cap 30. Drive shaft 28 and output line 7 extend through openings in cap 3 which are fitted with suitable seals to prevent gases from escaping from the tank. When ports 3 and 4 are closed, tank 1 is completely enclosed and vent line 15 provides the sole exit for vapors developed in the tank.

Figures 3, 3A, 3B, 4:
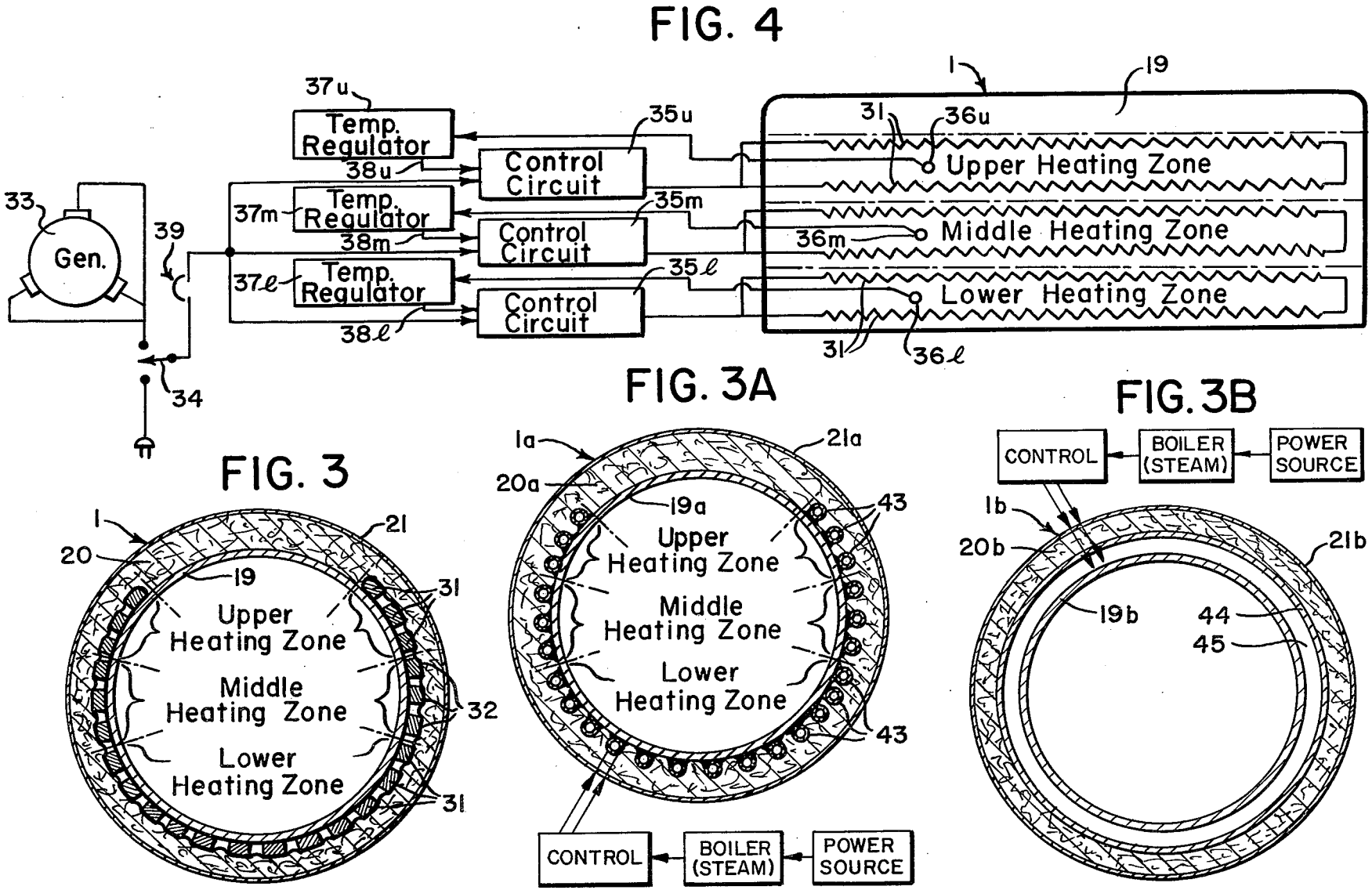
FIG. 3 is a cross-sectional view taken along line 3—3 of FIG. 2.
FIG. 3A is a cross-sectional view similar to FIG. 3, but of an alternate embodiment of the present invention.
FIG. 3B is a cross-sectional view similar to FIG. 3, but of another alternate embodiment of the invention.
FIG. 4 is a block diagram of the heating circuits of the preferred embodiment of the invention.

Referring now to FIG. 3, it can be seen that tank 1 is divided into three heating zones each associated with independently controlled strip heaters 31 mounted on the outside of inner vessel 19. The strip heaters 31 are electric resistive elements constructed of chromalox or any other suitable material and cemented to vessel 19 by a layer of asbestos furnace cement 32, which also serves to insulate the heaters electrically while maintaining the strip heaters in thermal contacting relation with tank 19. It can be seen that heat is directed to the asphalt in the tank through the walls of inner vessel 19.

The three heating zones in which the tank walls are divided are referred to in the drawings as the "upper", "middle" and "lower" heating zones, also referred to as *u*, *m* and *l*, respectively. Each heating zone is associated with a portion of the tank extending lengthwise along the tank and approximately parallel to the surface of the molten asphalt in the tank. The upper and middle zones are each associated with two strips, one on either side of the tank, while the lower zone extends from the middle zone on one side to the middle zone on the opposite side of the tank. The strip heaters 31 located in a single heating zone are all controlled by the same power controller, as will be discussed in more detail below.

FIGS. 3A and 3B depict alternate embodiments of the invention in which elements corresponding to like elements of the embodiment of FIG. 3 are identified by the letter designations *a* and *b* respectively. In the embodiment depicted in FIG. 3A, steam tubes 43 are secured to the outside of inner vessel 19. Tank 1 is divided into three heating zones as in the embodiment depicted in FIG. 3 with each heating zone associated with independently controlled steam tubes. Steam tubes 43 are connected to respective outlets of a water boiler (not shown) which supplies steam to the tubes for heating the asphalt. The temperature and quantity of steam directed through tubes 43 corresponding to each heating zone is regulated to maintain the walls of inner vessel 19 corresponding to the respective heating zone at a constant temperature.

In the embodiment depicted in FIG. 3B, inner vessel 19 is disposed within an intermediate vessel 44. Vessel 19 and vessel 44 are fluid and vapor impermeable. A heated fluid such as steam or combustion vapors from a burner are circulated in space 45 between vessels 19 and 44 to heat the asphalt contained in vessel 19. A control device regulates the quantity and temperature of the heated fluid or combustion vapors circulated in chamber 45 so that the temperature of the inner walls of vessel 19 are maintained at a preselected value.

FIG. 4 is a schematic diagram of the heating circuits which control the heating elements of each zone. Generator 33 is a three-phase electric power generator which is powered by a diesel motor. Control circuits 35*u*, 35*m* and 35*l* are connected in parallel to the three lines of generator 33 across triple-pole switch 34, — shown schematically in the diagram as a single-pole switch — which permits an external source of three-phase electric power to be substituted for generator 33. Triple-pole circuit breaker 39 is shown schematically as a single-pole circuit breaker. For illustration purposes the strip heaters 31 are shown schematically in FIG. 4 as resistive elements connected in series mounted on the side of tank 19; the actual circuit configuration of the strip heaters is described below. Each of the three control circuits 35 controls the power supplied to the strip heaters in a single heating zone of the tank.

Thermocouples 36*u*, 36*m* and 36*l* are mounted on the side of the tank adjacent each respective zone and each thermocouple is connected to a corresponding regulator 37 and an electrical feedback circuit. The feed-back responds to the temperature of the wall in particular heating zone as measured by the respective thermocouple 36. A control signal is generated and transmitted along an appropriate output line 38 from the temperature regulator to an associated control circuit 35. The control circuits 35*u*, 35*m* and 35*l* are adapted to produce signals on the lines 38 to regulate the power to the strip heaters to maintain the walls of inner vessel 19 located in a particular heating zone at a substantially constant temperature within the desired temperature range as preselected with temperature regulator 37.

Figure 5:
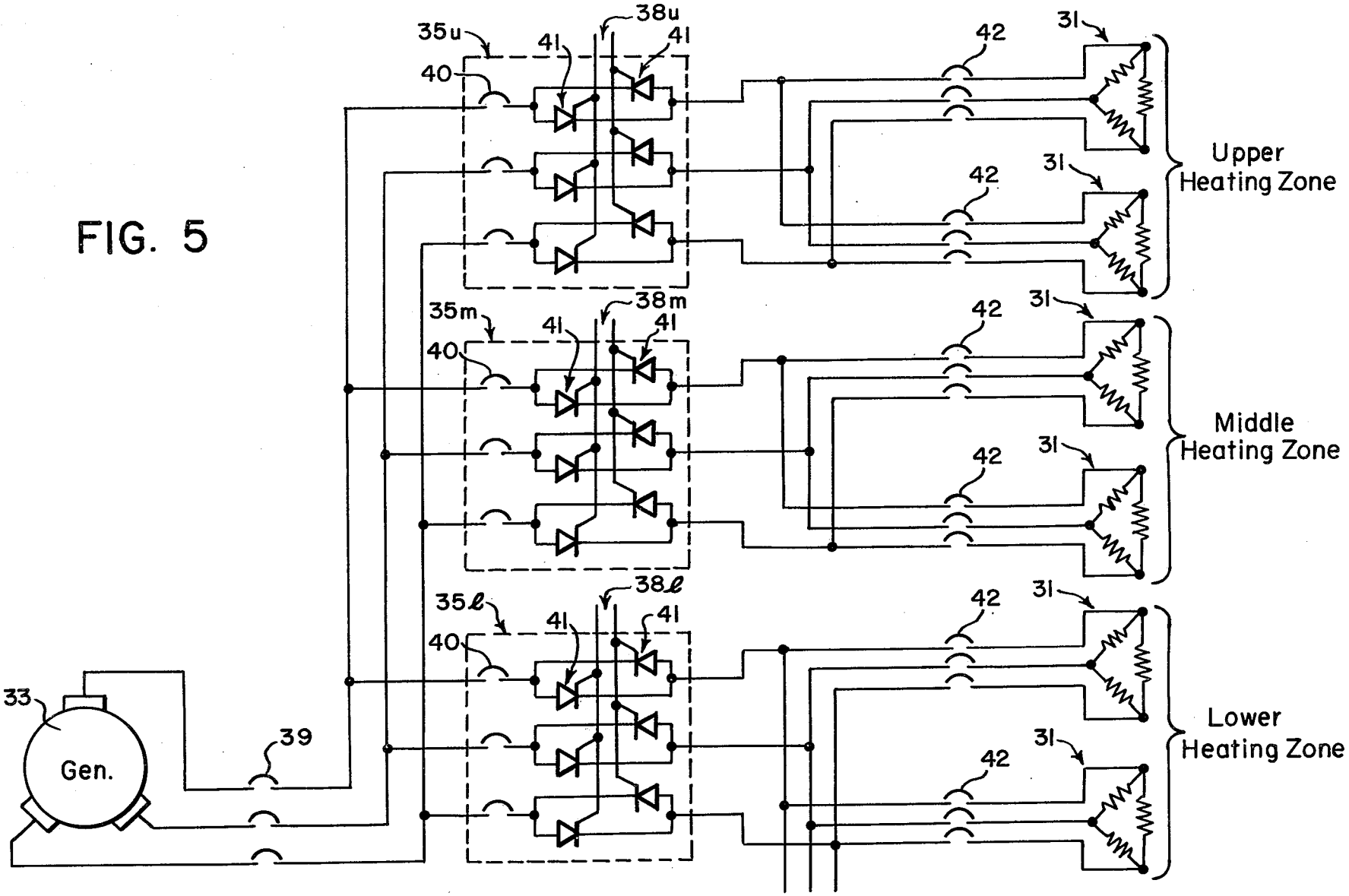
FIG. 5 is a simplified circuit diagram of the heating circuits of the preferred embodiment of the invention.

Referring now to FIG. 5, there is illustrated a simplified circuit diagram of the power control circuit shown in FIG. 4. For the purposes of illustration, switch 34 is omitted. Generator 33 is connected to the control circuits 35 across triple-pole circuit breaker 39. Each control circuit 35 comprises a triple-pole circuit breaker 40 in series with a silicon-controlled rectifier circuit 41. The silicon-control rectifier circuit shown regulates the amount of alternating current (AC) passing through it in response to control signals received along lines 38 from temperature controllers 37. The details of the circuits making up temperature regulators 37 for controlling silicon-controlled rectifiers in response to a bimetallic thermocouple are not shown. The output of the control circuits 35 are connected to the strip heaters 31 across circuit breakers 42, which are provided to protect against short-circuits in the heater circuits. The strip heaters are connected in a delta configuration in this embodiment because a three-phase generator 33 was used.

In operation, asphalt in a liquid or solid phase is deposited into the tank 1 and the temperature of the wall portions which contact the asphalt is preselected at control panel 14 to be maintained at approximately 500° F. Heat is thus distributed over the inner surface of the inner vessel 19 and the temperature of the asphalt ultimately rises to about 500° to 510° F, ultimately becoming uniform throughout the volume of the asphalt. The electrical power supplied to the heating elements associated with each of the three heating zones is adjusted by the individual temperature regulators 37 so that the temperature of the inner surface of the tank corresponding to each heating zone is maintained at approximately 500° F. When the tank is filled to its maximum capacity with liquid asphalt the level of the liquid is above the upper boundary of the upper heating zone. As asphalt is withdrawn from the tank by means of pump 27 the level will drop, ultimately falling below the upper heating zone. When the level of liquid asphalt in the truck drops below the upper heating zone, less power will be required to maintain the walls of the upper heating zone at the preselected temperature than when the walls are in contact with liquid asphalt. Temperature regulator 37*u* will automatically reduce the amount of electric power supplied to the heaters of the upper heating zone in order to maintain the temperature of the zone approximately constant. Thus asphalt adhering to the sides of the inner surface of the tank 19 adjacent to the upper heating zone when the level of liquid asphalt drops below the zone will not be heated to excessive temperatures and therefore not be decomposed into harmful air pollutants. Similarly the temperature of the walls of the middle and lower heating zones remains approximately constant as the tank is emptied.

I claim:

1. An apparatus for heating and maintaining an asphalt material to temperatures within a preselected range which comprises an enclosed vessel configured to contain the material in at least one of a solid and liquid state, inlet means for introducing the material into the vessel in at least one of a solid and liquid state, means for heating at least one of the wall portions of the vessel to maintain the temperature of at least one of the inner wall portions which contact the material therein and the material in the vessel above the melting temperature and below the decomposition temperature of the asphalt material, the surface area of heated wall portions contacting the material being sufficient to transfer heat to the material at least sufficient to maintain the temperature of the material to within said preselected range in a manner to avoid causing substantial decomposition thereof, control means for selectively controlling the temperatures of the heating means to maintain at least one of the inner wall portions of the vessel contacting asphalt material thereon and the asphalt material in the vessel within said preselected temperature range, venting means communicating an upper portion of the vessel with an atmosphere outside of the vessel, filtering means capable of filtering vapors such as condensible hydrocarbon vapors communicating with said venting means, and outlet means for removing the material from said vessel.

2. An apparatus for heating and maintaining an asphalt material to temperatures within preselected ranges, comprising an enclosed vessel configured to contain the material in at least one of a solid and liquid state, inner surface portions of the vessel defining at least first and second upper and lower heating zones, each having boundaries generally parallel to a horizontal plane when the apparatus is in a horizontal rest position; inlet means for introducing the material in at least one of a solid and liquid state; means for heating the heating zones of the vessel to maintain the temperature of the heating zones and the material in the vessel, within preselected temperature ranges, the surface area of the heating zones contacting the material being sufficient to transfer heat to the material to at least maintain the temperature of the material to within said preselected ranges while maintaining substantially all portions of the material below the decomposition temperature of the asphalt material; control means associated with each heating zone for independently controlling the temperatures of the separate heating zones to maintain the asphalt material in the vessel within said preselected temperature ranges; venting means communicating an upper portion of the vessel with an atmosphere outside of the vessel; outlet means for removing the material from said vessel; and means for transporting the vessel.

3. The apparatus according to claim 1 further comprising an inner vessel and outer vessel enclosing the inner vessel and in space relation with each other to define a peripheral chamber therebetween.

4. The apparatus according to claim 3 wherein said heating means comprises electrical heating elements positioned and secured to outer surface portions of the inner vessel in a manner which permits thermal conductivity and heat transfer from the heating elements through the wall portions of the inner vessel to the asphalt material within the vessel.

5. The apparatus according to claim 4 further comprising insulating material positioned between the outer vessel and the inner vessel and outward of the heating elements to prevent heat losses through wall portions of the vessel.

6. The apparatus according to claim 5 further comprising an electrical generator for producing electrical energy, means for transmitting electrical energy produced by said generator to said electrical heating elements, and means for supplying power to said electrical generator.

7. The apparatus according to claim 6 further comprising temperature sensing means at least in one of a position adjacent wall portions of the inner vessel and within the material therein, and electrical control means connected to the temperature sensing means for controlling the temperature of the electrical heating elements in response to signals transmitted by said temperature sensing means.

8. The apparatus according to claim 7 wherein inner surface portions of the inner vessel define at least two separate heating zones, each having upper and lower boundaries approximately parallel to a horizontal plane when the apparatus is in a horizontal rest position, each heating zone being associated with electrical heating means connected to an independent control means associated with the respective heating zone to facilitate independent control of the temperature of the separate heating zones of the vessel.

9. The apparatus according to claim 8 wherein the inner surface portions of the inner vessel define at least three separate heating zones, each zone having upper and lower boundaries approximately parallel to a horizontal plane when the apparatus is in a horizontal rest position, and electrical heating elements associated with each zone and affixed to the walls of the inner vessel in thermal conductive relationship therewith, electrical control means associated with each heating zone for independently controlling the temperature of each heating zone in response to heat sensing means associated with each heating zone, so as to maintain the temperature within preselected ranges, and means for independently deactivating the heating elements of each heating zone such that selected heating zones may be independently controlled or deactivated as material is removed from the inner vessel.

10. The apparatus according to claim 9 further comprising an internal combustion engine adapted to provide power to said electrical generator to produce said electrical energy.

11. The apparatus according to claim 10 further comprising a control terminal having control means operatively connected with said control circuitry of said heating elements for selectively operating said heating elements and preselecting the temperatures required to maintain asphalt in a molten condition.

12. The apparatus according to claim 11 wherein said means for supplying power to said electrical generator comprises an internal combustion engine and said venting means communicates with the air intake of the internal combustion engine such that air polluting vapors exiting from said vessel are burned within said internal combustion engine.

13. The apparatus according to claim 12 further comprising at least one canister type filtering means communicating with said venting means for removing hydrocarbon vapors from air exiting through said venting means.

14. The apparatus according to claim 13 wherein said filtering means comprises at least one cylindrical canister having a gas inlet and a gas outlet, said canister having a fiberglass filtering material positioned therein for filtering air polluting hydrocarbon vapors passing therethrough.

15. The apparatus according to claim 14 further comprising a movable vehicle trailer supporting said inner and outer vessels and associated heater and control means.

16. The apparatus according to claim 15 wherein said vehicle trailer is attached to a motor vehicle to provide portability and mobility to said apparatus.

17. The apparatus according to claim 16 further comprising means for pumping the molten asphalt out of the vessel and means for directing the asphalt onto surface portions requiring the application thereof.

18. The apparatus according to claim 3 further comprising steam tubes positioned within the chamber between said outer and inner vessels to supply heat to wall portions of said inner vessel, and at least one water boiler operatively connected to supply steam to said steam tubes, with means to supply power to said water boiler for producing steam therein.

19. The apparatus according to claim 18 further comprising means positioned within the material in the inner vessel for sensing the temperature therein and means for controlling and regulating the steam supplied to said tubular members in accordance with the temperatures attained within the inner vessel.

20. The apparatus according to claim 17 wherein inner surface portions of the inner vessel define at least two separate heating zones, each having upper and lower boundaries approximately parallel to a horizontal plane when the apparatus is in a horizontal rest position, each heating zone being associated with steam tubes connected to an independent control means associated with the respective heating zone such that the temperature of separate heating zones of the vessel may be independently controlled.

21. The apparatus according to claim 3 wherein said outer and inner vessels are constructed to be impermeable to fluids under pressure and further comprising means for introducing and circulating a heated fluid within the chamber defined by said outer and inner vessels to heat inner wall portions of the vessel.

22. The apparatus according to claim 21 further comprising means for sensing the temperature within the inner vessel, and means for controlling and regulating said heated fluid introduced to said chamber between said inner and outer vessels in accordance with the temperatures attained therein.

23. The apparatus according to claim 22 wherein said means for introducing said heated fluid within the chamber between said outer and inner vessels comprises a water boiler with means connected thereto for introducing steam at elevated temperatures within said chamber defined by said vessels.

24. The apparatus according to claim 3 wherein said outer and inner vessels are of a vapor impermeable construction and the apparatus further comprises means for heating wall portions of aid inner vessel in the form of a burner adapted and connected for introducing hot combustion gases within the chamber defined between said outer and inner vessels.

25. The apparatus according to claim 24 further comprising means for sensing the temperature within the inner vessel and means for controlling and regulating the hot combustion gases supplied to said chamber between said inner and outer vessels in accordance with the temperatures attained therein.

26. An apparatus for heating and maintaining asphalt in a molten condition and below its decomposition temperatures which comprises:

a. an enclosed vessel configured to contain the asphalt in its liquid state, said vessel being comprised of an inner vessel and an outer vessel enclosing the inner vessel in spaced relation therewith to define a peripheral chamber therebetween, said vessel further being divided in upper, middle, and lower heating zones;

b. independent electrical heating elements associated with each heating zone and secured to outer surface portions of said inner vessel adjacent each respective zone and in thermal conductive relation therewith;

c. an electrical generator adapted for producing and transmitting electrical power to said heating elements so as to produce heat for heating the wall portions of the inner vessel;

d. an internal combustion engine adapted to produce and supply motive power to said electrical generator;

e. at least one venting means communicating between an upper portion of the inner vessel and the input end of a canister type filtering means, said filtering means having a filtering material therein capable of removing volatile hydrocarbon vapors from gases exiting from the inner vessel;

f. means for connecting the output of the filtering means with the air/fuel inlet of said internal combustion engine such that atmospheric polluting hydrocarbon vapors which pass through the filtering means are burned with fuel in said engine;

g. independent sensing means for detecting the temperature of the inner walls of said vessel at each of said heating zones and producing a signal in accordance therewith;

h. means for preselecting the temperature desired in each heating zone;

i. electrical control means associated with each heating zone adapted for independently controlling the temperature developed in each heating zone in accordance with the signal produced by the sensing means associated with the respective heating zone and for deactivating the heat supplied to each heating zone;

j. an input means for introducing asphalt material into said vessel;

k. means for sealing the input means in a manner to prevent air polluting vapors from exiting therefrom;

l. a pumping means for removing asphalt from the vessel in its liquid state;

m. a power source for operating the pumping means;

n. means for directing the liquid asphalt removed from said vessel onto surfaces requiring the application of asphalt;

o. wall members laterally positioned within said inner vessel in a manner to prevent excessive splashing of the molten asphalt during transit; and p. a movable trailer supporting the vessel and associated equipment, said trailer having means for attaching it to a motor vehicle for transporting the apparatus from place to place.

27. A system for heating a material such as asphalt in at least one of a solid and liquid state in an enclosed vessel defining at least two heating zones, and for independently controlling the temperatures of each heating zone within preselected temperature ranges which comprises:

a. at least one electrical heating element associated with each heating zone and positioned adjacent wall portions of the vessel in thermal conducting relation with the inner wall portions thereof;

b. an electrical generator means adapted to produce and supply electrical current to said electrical heating elements;

c. means for supplying power to said electrical generator means for producing said electrical current supplied to said heating elements;

d. means for sensing the temperature attained in each heating zone;

e. a temperature regulator associated with each heating zone, each regulator having means for preselecting the temperature desired to be attained in the associated heating zone;

f. means for transmitting a signal from each temperature sensing means to the associated temperature regulator in accordance with the temperature attained in the associated heating zone;

g. means in each temperature regulator for producing a signal in accordance with the difference between the preselected temperature and the temperature actually attained in the associated heating zone; and h. a control circuit adapted for receiving the signal produced by the associated temperature regulator and for transmitting electrical energy from said electrical generator means to said electrical heating elements in relation to the signal produced by said temperature regulator such that the electrical energy supplied to said heating elements and the heat transmitted to each heating zone by the associated heating elements is produced in accordance with the difference between the preselected temperature and the temperature actually attained in the associated heating zone.

28. The control system according to claim 27 further comprising means for independently and selectively controlling or deactivating the electrical energy transmitted to said heating elements to regulate the heat supplied to said heating elements and the resulting temperature attained in each associated heating zone.

29. The control system according to claim 28 wherein said temperature sensing means associated with each heating zone comprises at least one bimetallic thermocouple and each temperature regulator comprises a combination of silicon controlled rectifiers responsive to each associated thermocouple.

30. The control system according to claim 29 wherein each electrical heating element associated with each heating zone comprises at least two heating bridges, each bridge being formed of at least three electrical resistors connected to each other to form a substantially triangular circuit configuration which produces and conducts heat to the adjacent inner wall of said vessel due to the thermally conductive adjacent position with respect thereto.

31. The control system according to claim 30 further comprising a three phase alternating current electrical generator and the control circuit for controlling the electrical energy transmitted to each electrical heating element comprises a triple-pole circuit breaker connected in series with at least one silicon controlled rectifier circuit to regulate current passing through said circuit in response to control signals received from said temperature control means.

32. The control system according to claim 31 wherein said generator is connected to said control circuits across at least one triple-pole circuit breaker.

33. An apparatus for heating and maintaining an asphalt material to temperatures within preselected ranges, comprising an enclosed vessel configured to contain the material in at least one of a solid and liquid state, inner surface portions of the vessel defining at least first and second upper and lower heating zones, each having boundaries generally parallel to a horizontal plane when the apparatus is in a horizontal rest position; inlet means for introducing the material in at least one of a solid and liquid state; means for heating the heating zones of the vessel to maintain the temperature of the heating zones and the material in the vessel, within preselected temperature ranges, the surface area of the heating zones contacting the material being sufficient to transfer heat to the material to at least maintain the temperature of the material to within said preselected ranges in a manner to avoid causing substantial decomposition thereof; control means associated with each heating zone for independently controlling the temperatures of the separate heating zones to maintain the asphalt material in the vessel within said preselected temperature ranges; venting means communicating an upper portion of the vessel with an atmosphere outside of the vessel; and outlet means for removing the material from said vessel.

34. A method of processing asphalt material for application to a surface in a molten state comprising the steps of:

a. introducing the asphalt material into a portable container, the walls of the container being thermally insulated from inside the vessel to an atmosphere outside the vessel;

b. directing heat to an inner wall portion of the container which contacts molten asphalt material having a combined surface area to maintain and control the temperature of the asphalt material above the melting temperature and below the decomposition temperature of the asphalt material;

c. controlling the temperature of heated inner wall portions of the vessel which contact the asphalt material to within the temperature range above the melting temperature and below the decomposition temperature of the asphalt material, the surface area of the heated inner wall portions which contact the asphalt material being sufficient to transfer heat to the asphalt material at least sufficient to maintain the asphalt material in a molten condition in a manner to avoid causing substantial decomposition thereof; and d. discharging molten asphalt material from the container for application to the surface.

35. The method according to claim 34 further comprising heating substantially all inner wall portions of the container which contact molten asphalt material to a temperature above the melting temperature and below the decomposition temperature of the asphalt material.

36. The method according to claim 35 further comprising heating the inner wall portions electrically.

37. The method according to claim 34 further comprising introducing the asphalt material into the container in a solid state and heating inner wall portions of the container which contact asphalt material to a temperature sufficient to melt the asphalt and maintain it in said molten condition.

38. The method according to claim 34 in which the container is substantially completely enclosable and further comprising the step of:

e. venting the interior of the container to an atmosphere outside of the vessel through a filtering means capable of removing vapors such as condensible hydrocarbon vapors generated within the container.

* * * * *

UNITED STATES PATENT AND TRADEMARK OFFICE

CERTIFICATE OF CORRECTION

PATENT NO. : 4,028,527

DATED : June 7, 1977

INVENTOR(S) : George F. Thagard, Jr.

It is certified that error appears in the above-identified patent and that said Letters Patent are hereby corrected as shown below:

Column 6, line 34, "cap 3" should read --cap 30--.

Column 7, line 45, "in particular" should read --in a particular--.

Column 11, line 35, "of aid inner" should read--of said inner--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*